United States Patent [19]

Murphy

[11] 3,950,805

[45] Apr. 20, 1976

[54] COMBINATION PROVIDING SAFETY BERTHING, UNLOADING OF OIL, AND CONDUIT CARRIAGE TO REFINERIES ON LAND, OF LARGE DEEP-SEA-REQUIRING TANKERS

[75] Inventor: Christopher J. Murphy, Douglaston, N.Y.

[73] Assignee: Parson, Brinkerhoff, Quade & Douglas, Inc., New York, N.Y.

[22] Filed: Jan. 14, 1974

[21] Appl. No.: 432,857

[52] U.S. Cl. ..... 9/8 P; 61/46.5

[51] Int. Cl.[2] ..... B63B 21/52

[58] Field of Search ..... 114/.5 R, .5 T, .5 D, 114/232, 233; 9/8 P, 8.5; 61/46, 46.5, 50, 53

[56] References Cited

UNITED STATES PATENTS

| | | | |
|---|---|---|---|
| 1,313,838 | 8/1919 | Stodder | 61/46 |
| 3,086,367 | 4/1963 | Foster | 9/8 P |
| 3,188,816 | 6/1965 | Koch | 61/46 |
| 3,372,409 | 3/1968 | Manning | 9/8 P |
| 3,612,177 | 10/1971 | Gassett | 61/46.5 |
| 3,668,875 | 6/1972 | Sander et al. | 61/46 |
| 3,738,113 | 6/1973 | Madary et al. | 114/.5 T |
| 3,765,463 | 10/1973 | Gassett et al. | 61/46 |
| 3,783,816 | 1/1974 | de Chassy et al. | 9/8 P |

FOREIGN PATENTS OR APPLICATIONS

| | | | |
|---|---|---|---|
| 668,272 | 9/1964 | Italy | 61/46 |

*Primary Examiner*—Trygve M. Blix
*Assistant Examiner*—Jesus D. Sotelo
*Attorney, Agent, or Firm*—W. Lee Helms

[57] ABSTRACT

A subaqueous conduit extends from a mainland terminal and leads to the base of a tubular mooring stanchion which extends above the sea surface. The base of the stanchion is located at a depth of up to 100 fathoms adapting the stanchion for the mooring of very large oil tankers. Secured to the stanchion is a double floating pontoon structure to which tankers can berth. The tankers are moored alongside the pontoon structure and discharge their oil through swivel-jointed tubes at the upper portion of the stanchion which permit relative motion of the tanker caused by sea conditions. The pontoon structure can be ballasted to submerge the same to a predetermined depth during adverse weather conditions. The stanchion may receive oil from two tankers simultaneously and is adapted for connection to a plurality of submarine conduits by which oil from the stanchion may be received at a plurality of land-based reception points.

6 Claims, 19 Drawing Figures

19
19
13
14
19
13
14
38
10
38
38
12
4b
4b
11
11
1
12
19
19
29
28
15

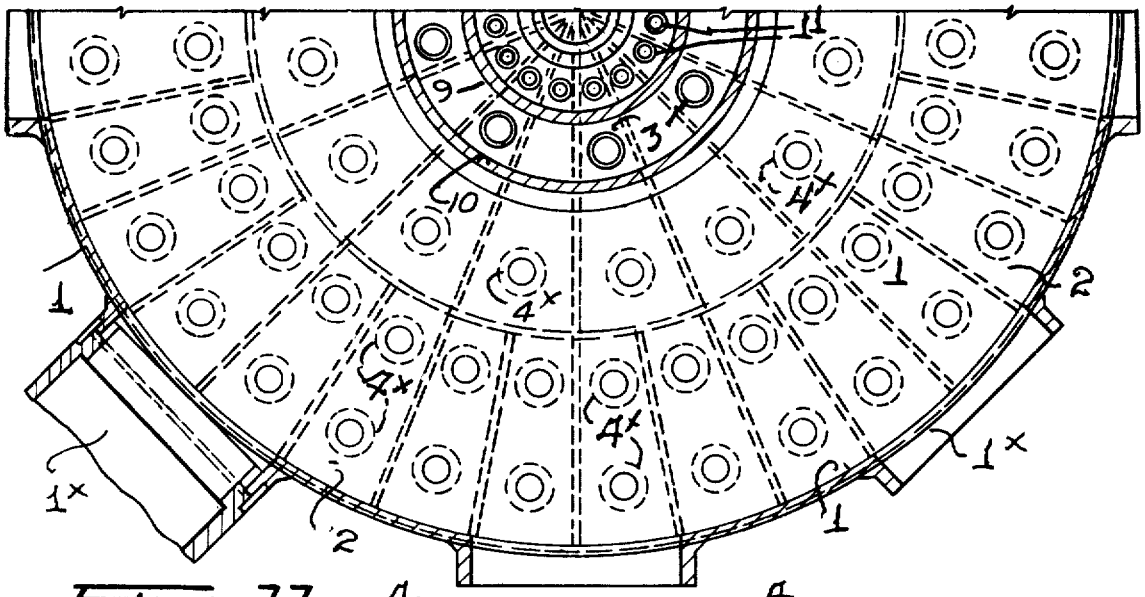
FIG. 11
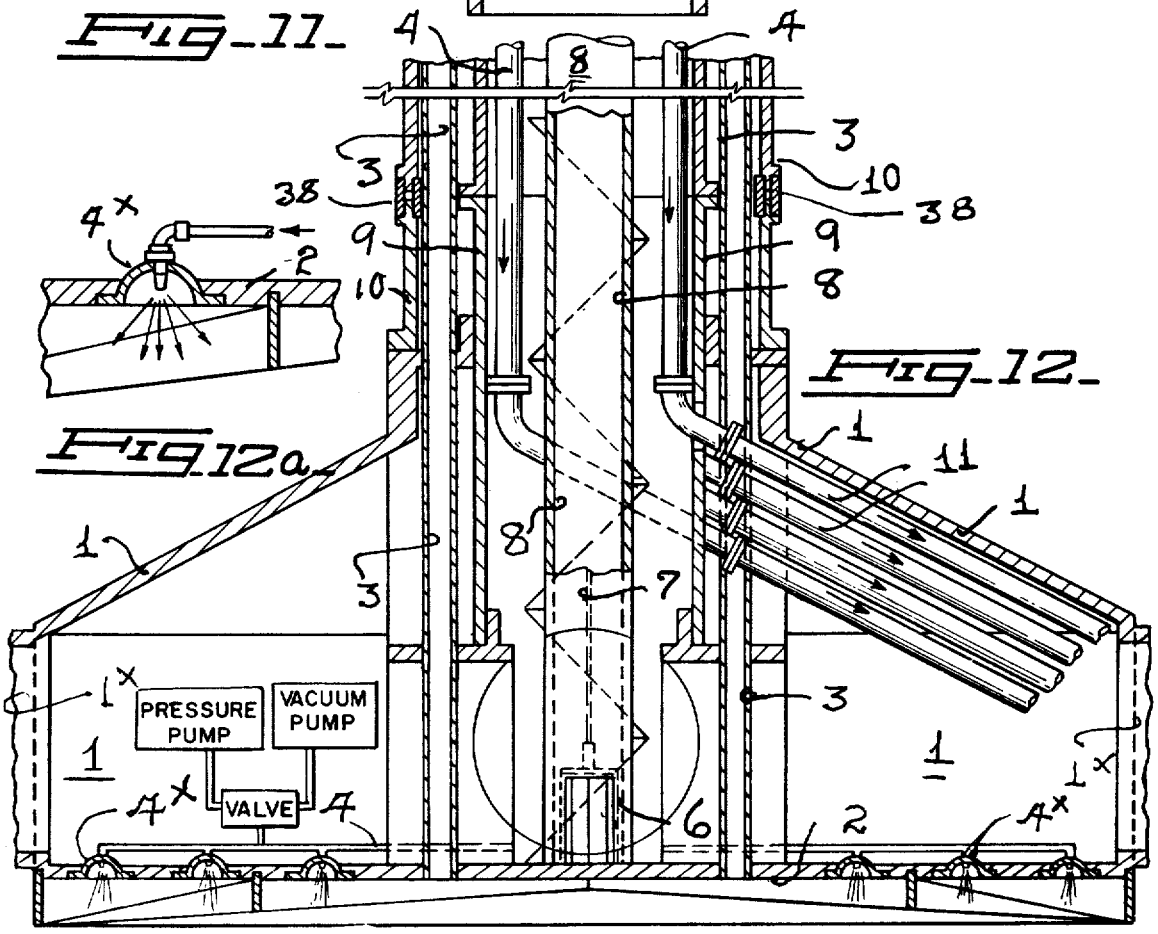
FIG. 12
FIG. 12a

COMBINATION PROVIDING SAFETY BERTHING, UNLOADING OF OIL, AND CONDUIT CARRIAGE TO REFINERIES ON LAND, OF LARGE DEEP-SEA-REQUIRING TANKERS

The invention will be described with reference to the accompanying drawings, in which:

FIG. 1 is a perspective view, showing the stanchion with a communicating tunnel, and the "camel" with two tankers moored thereto, and with the tanker discharge conduits connected to the top of the stanchion.

FIG. 1*a* is a view in elevation of the upper area of the stanchion, and means schematically shown, for controlling the discharge conduits of the tanker or tankers and which lead to the top of the stanchion.

Figures 4, 4A, 4B:
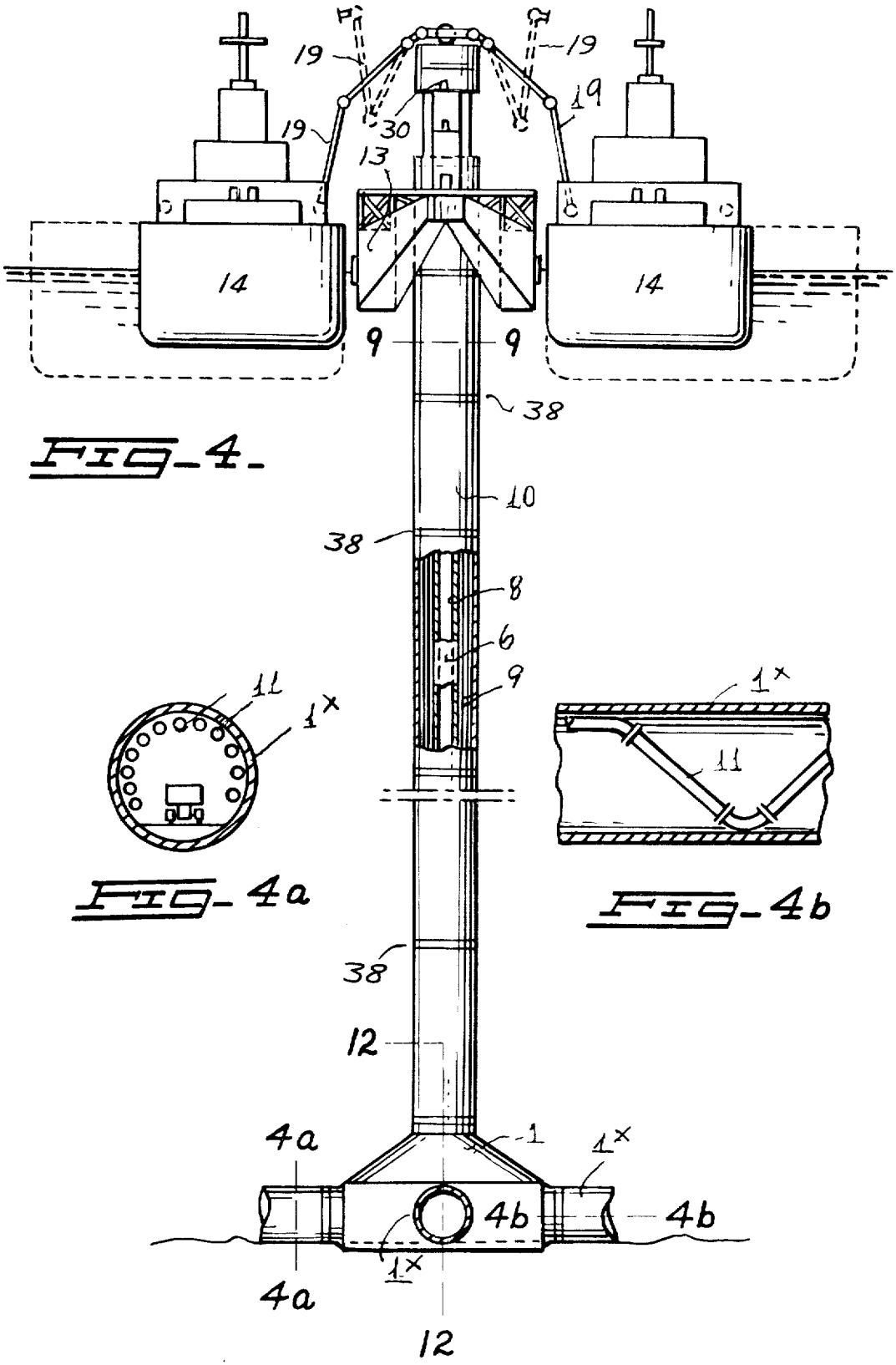
FIG. 4 is a view in elevation, partly broken away, showing the stanchion, the "camel," two tankers, and the oil discharge conduits, dotted lines indicating a position of the conduits when the tanker or tankers rise by sea action to an unusual degree.

FIG. 4*a* is a sectional view, on the line 4*a*—4*a*, FIG. 4, of a subaqueous tunnel with a modified arrangement of the oil conduits therein, and the tunnel floor.

FIG. 4*b* is a fragmentary longitudinal section, taken on the line 4*b*–4*b*, FIG. 4, of a subaqueous tunnel, showing one form of discharge conduit arrangement.

Figure 5:
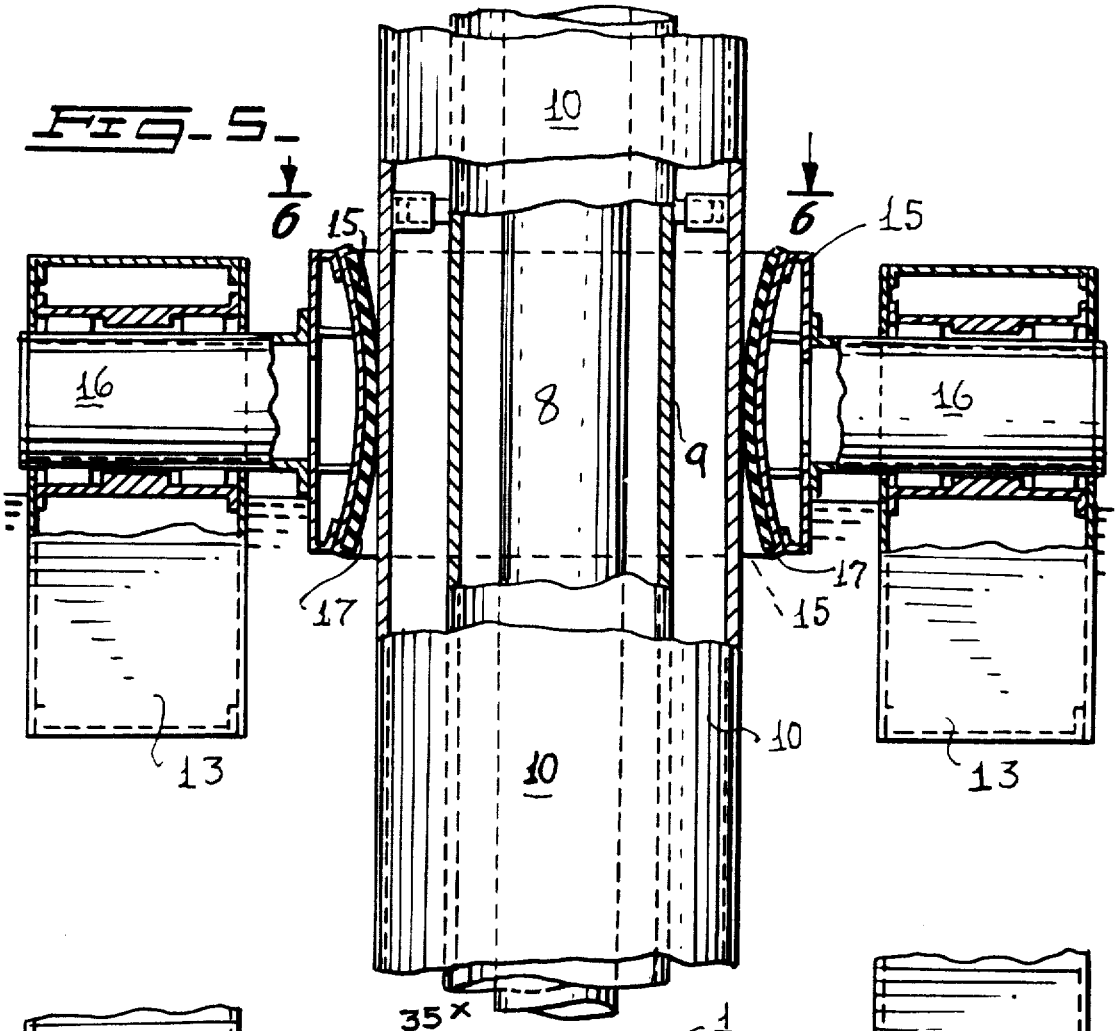

FIG. 5 is a view in elevation, and partly in section, showing primary elements of the "camel" in cushioned abutment with the stanchion, enabling the "camel" to move up and down, to have "pitch" fore and aft, and to rotate about the stanchion.

Figure 6:
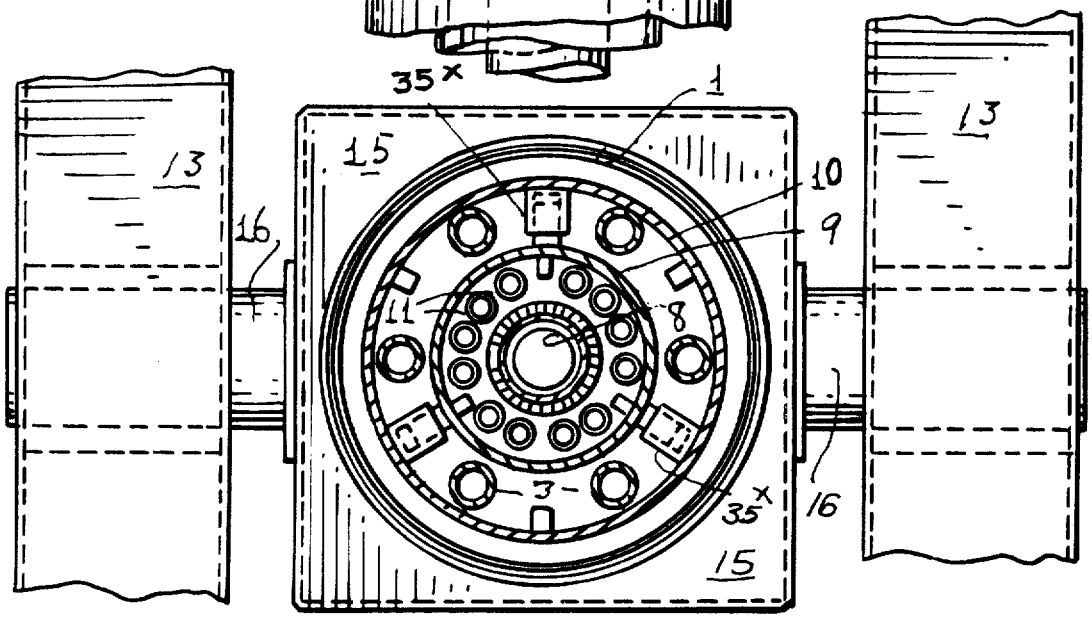

FIG. 6 is a horizontal section through the collar of the "camel" surrounding the stanchion at an upper end thereof and abutment with the stanchion by cushion elements of the "camel," the section being on the line 6—6, FIG. 5.

Figure 7:
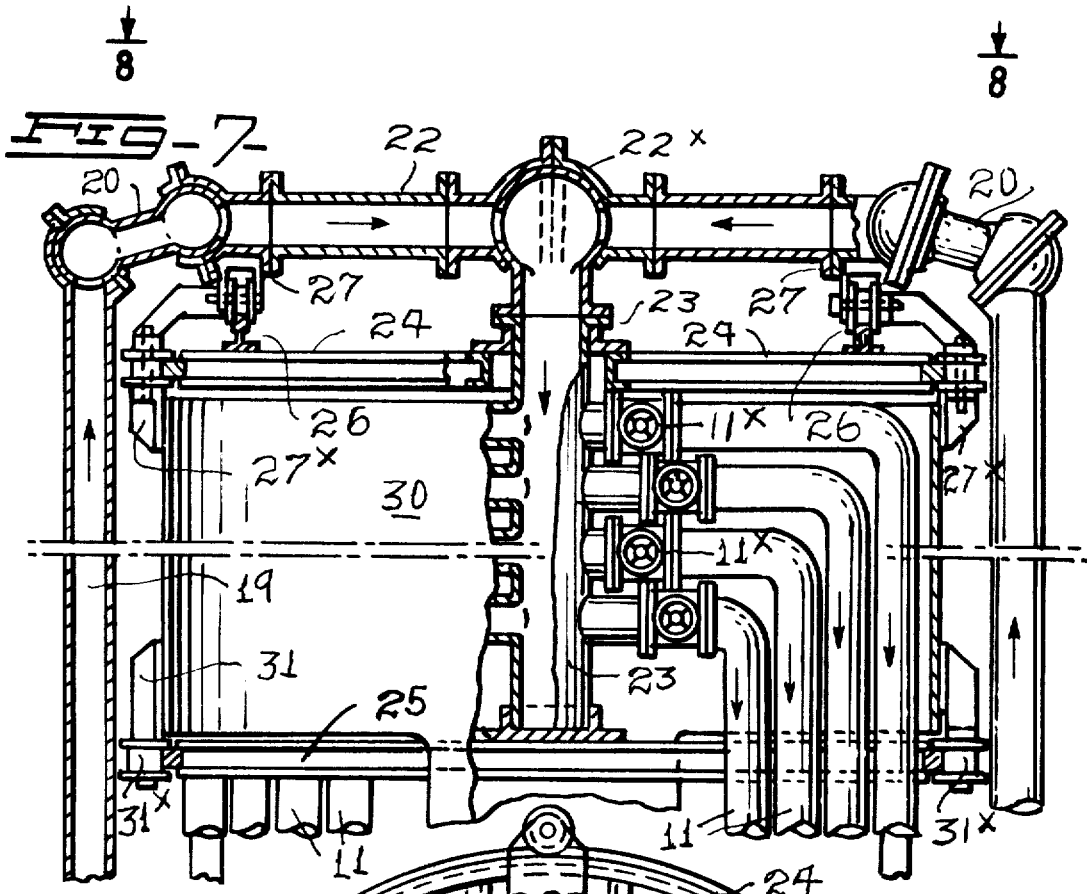

FIG. 7 is a fragmentary vertical section through the top area of the stanchion and showing the tanker oil discharge conduits, the stanchion down-delivery oil piping, and appurtenant controls.

Figure 8:
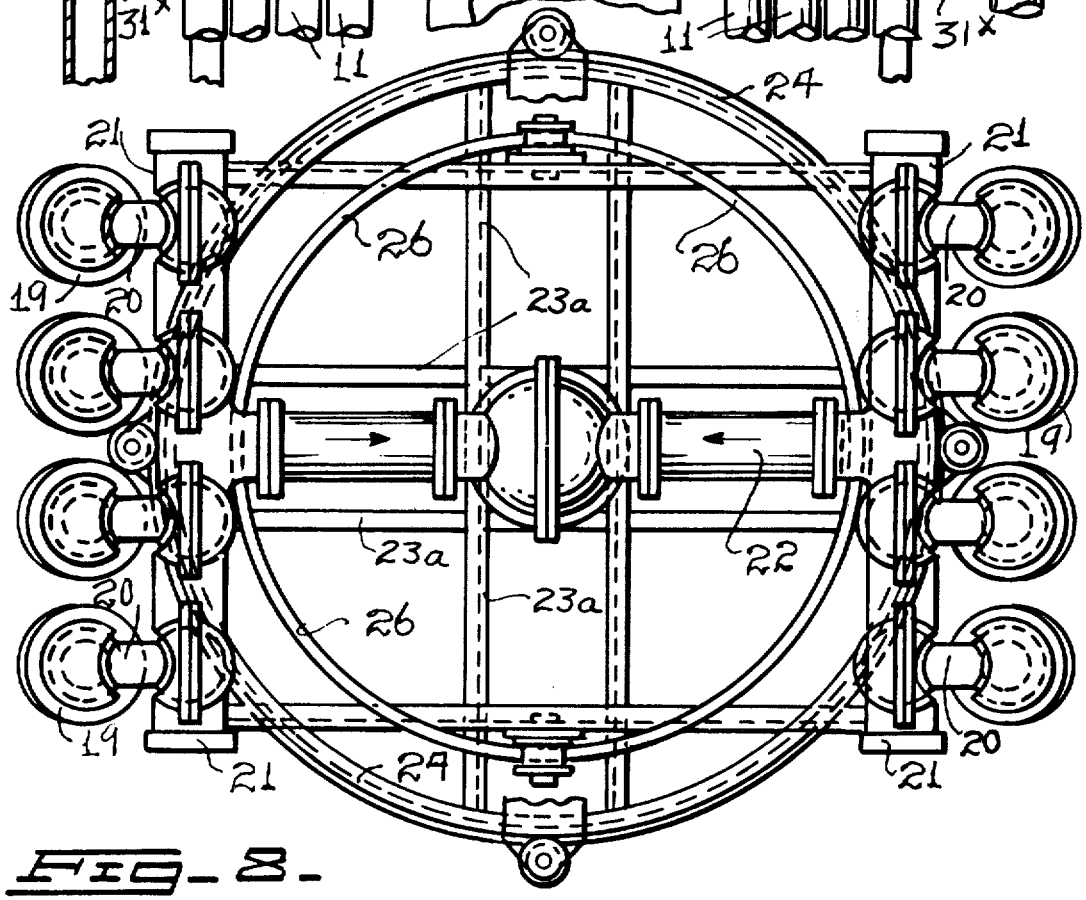

FIG. 8 is a top plan view of the structure shown in FIG. 7.

Figure 9:
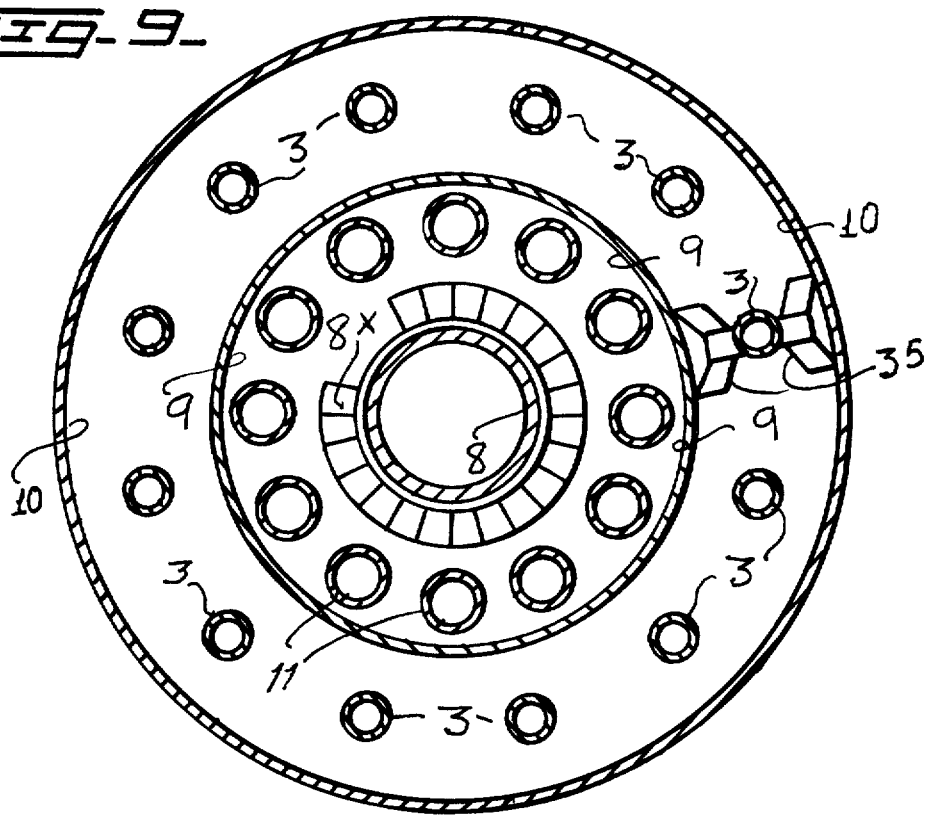

FIG. 9 is a horizontal section through the stanchion schematically showing the position of a spiral stairway, downflow piping for the oil received from a tanker, and tubular piling for the base footing of the stanchion, the section being on the line 9—9, FIG. 4.

Figure 10:
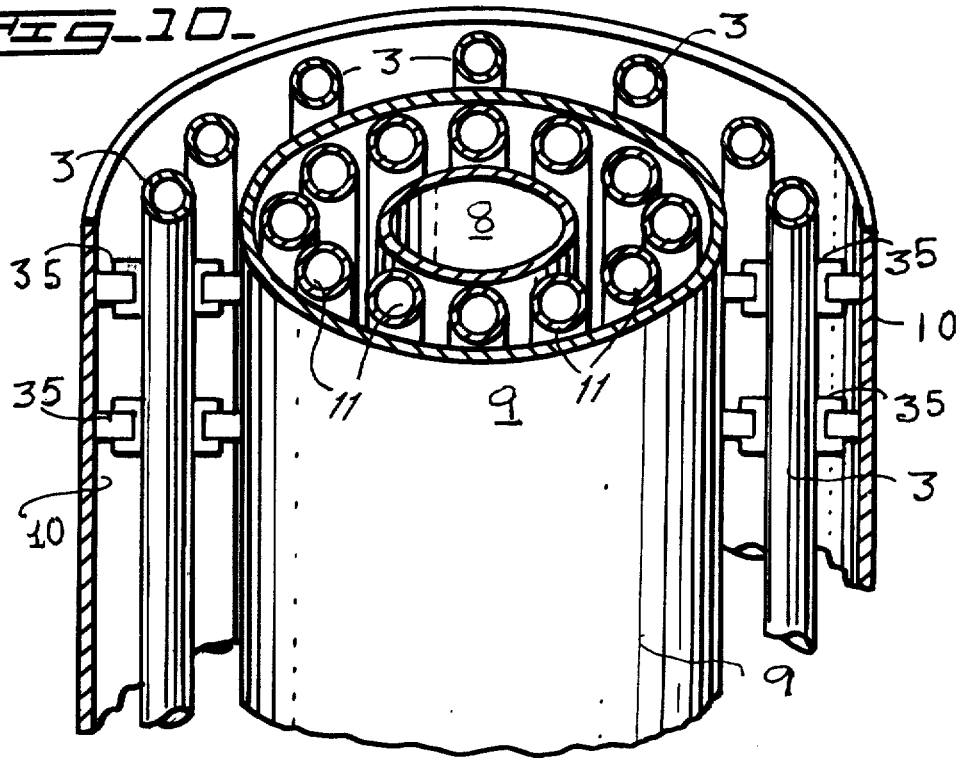

FIG. 10 is of the general construction shown in FIG. 9, omitting the stairway, and turned somewhat to perspective.

Figures 1, 1A:
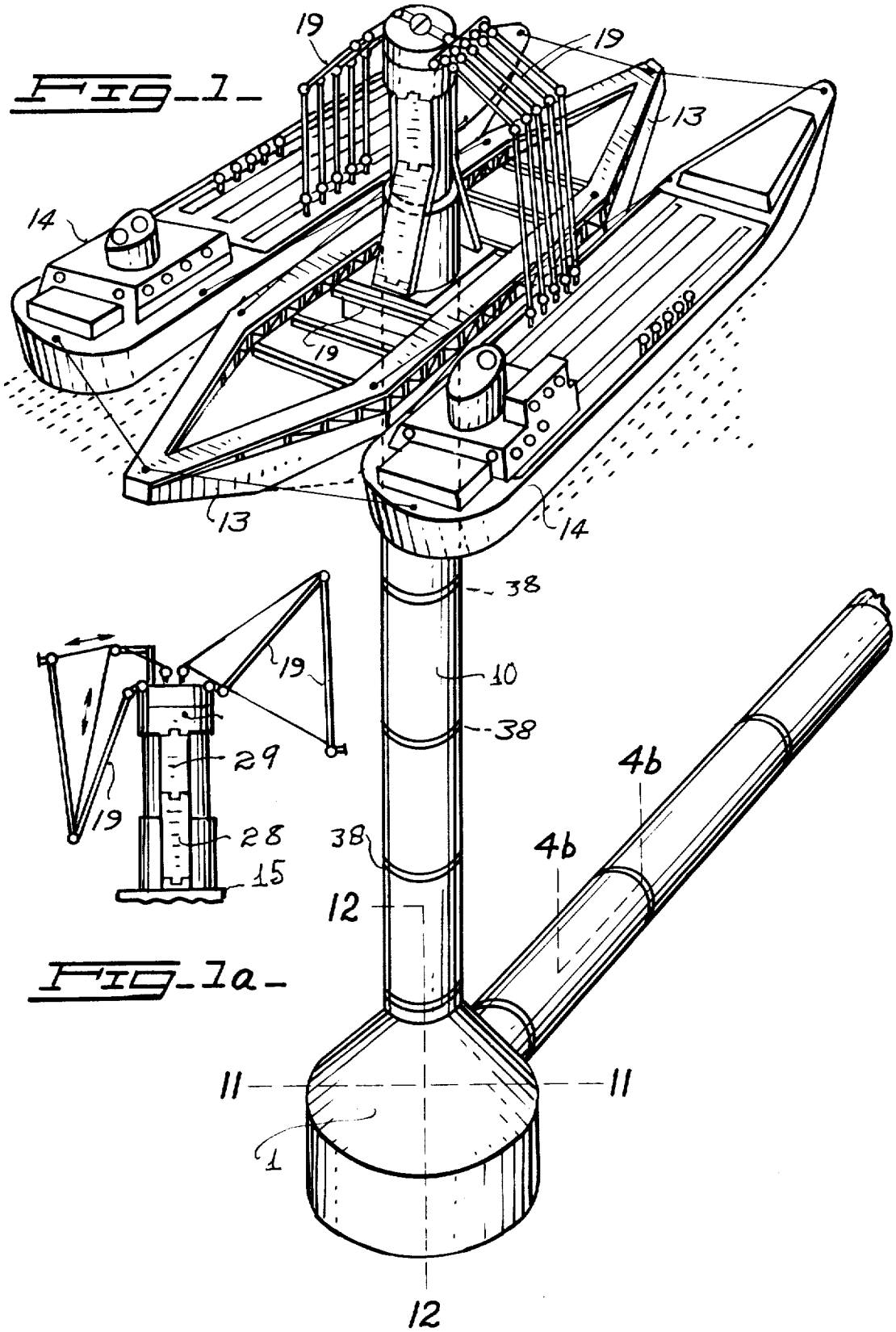

FIG. 11 is a one-half horizontal section through the base footing of the stanchion, on the line 11—11, FIG. 1, showing branch connecting tunnels and nozzle means for fluid pressure (or suction) piping.

FIG. 12 is a one-half vertical section, on the line 12—12, FIG. 1, through the base footing member of the stanchion, showing the arrangement of the tubular piling prior to be driven into the sea floor, an elevator, the three tubular members of the stanchion, a plurality of tunnel connecting apertures, and the arrangement of oil-flow piping leading to one tunnel.

FIG. 12*a* is a fragmentary detail view, partly in vertical section, showing the bottom wall of the base footing, and fluid pressure means applied thereto.

Figure 14:
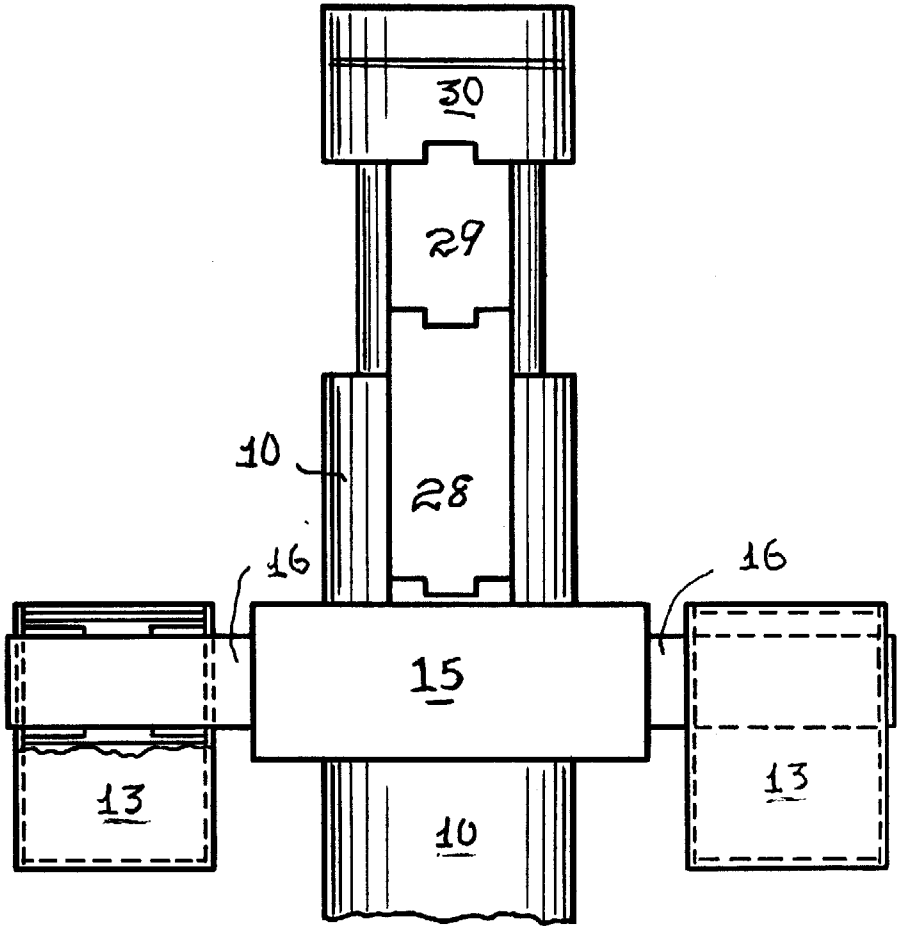
Figure 13:
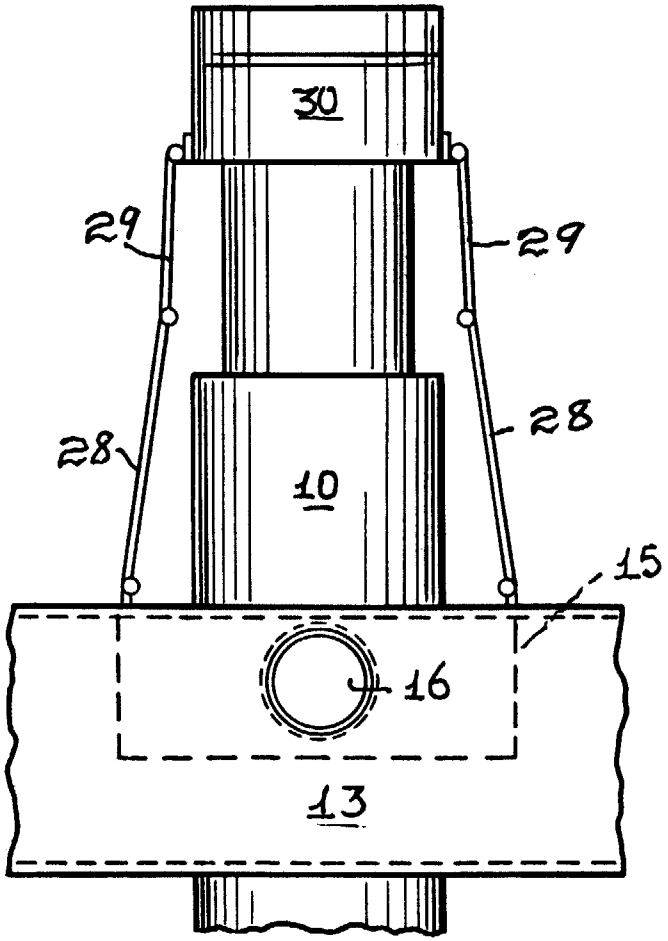

FIGS. 13 and 14 schematically illustrate the hinged plate connection between the "camel" and a rotatable sleeve on the stanchion at its top area.

THE STANCHION CONSTRUCTION

The stanchion is, in use, a fixed structure and necessarily heavy and strong, nevertheless it can be constructed in major completeness at shore points, and towed to the point for attachment to the base footing member. The stanchion general construction and that of the base footing is as follows:

The base footing of the stanchion is detailed in FIGS. 11, 12, and 12*a*, wherein its casing is indicated at 1, with a floor at 2 provided with a circular arrangement of apertures for tubular piles 3 to be driven into the sea bed. Means carried by the floor and including piping 4 communicating with nozzles 4$^{x}$ in the floor and with pressure (or suction) means, will assist sinking of the stanchion base footing the desired degree into the sea bed, whereupon the piles, here shown as tubular, may be driven down for secure bonding of the base footing when the stanchion assembly above it is applied.

Extending upwardly from the base footing 1 is the inner (8) tubular member of the stanchion assembly, it being of substantial strength to form an important member. It serves, also, as a communicating passage from bottom to top area of the stanchion, and in FIG. 12 is shown as receiving an elevator 6, having a hoist cable 7 to carry operators up to a platform at the top area of the stanchion and other areas thereof are provided for outward passage from said stanchion member. These platforms are not shown, the provision thereof being readily apparent.

In the embodiment shown in FIG. 9 is shown a spiral staircase surrounding stanchion member 8 as indicated at 8$^{x}$, which may lead from the base footing upwardly to various working platforms for operators of the stanchion and in accordance with requirements, as auxiliary to the elevator or as supplanting it.

Figures 2, 2A, 3:
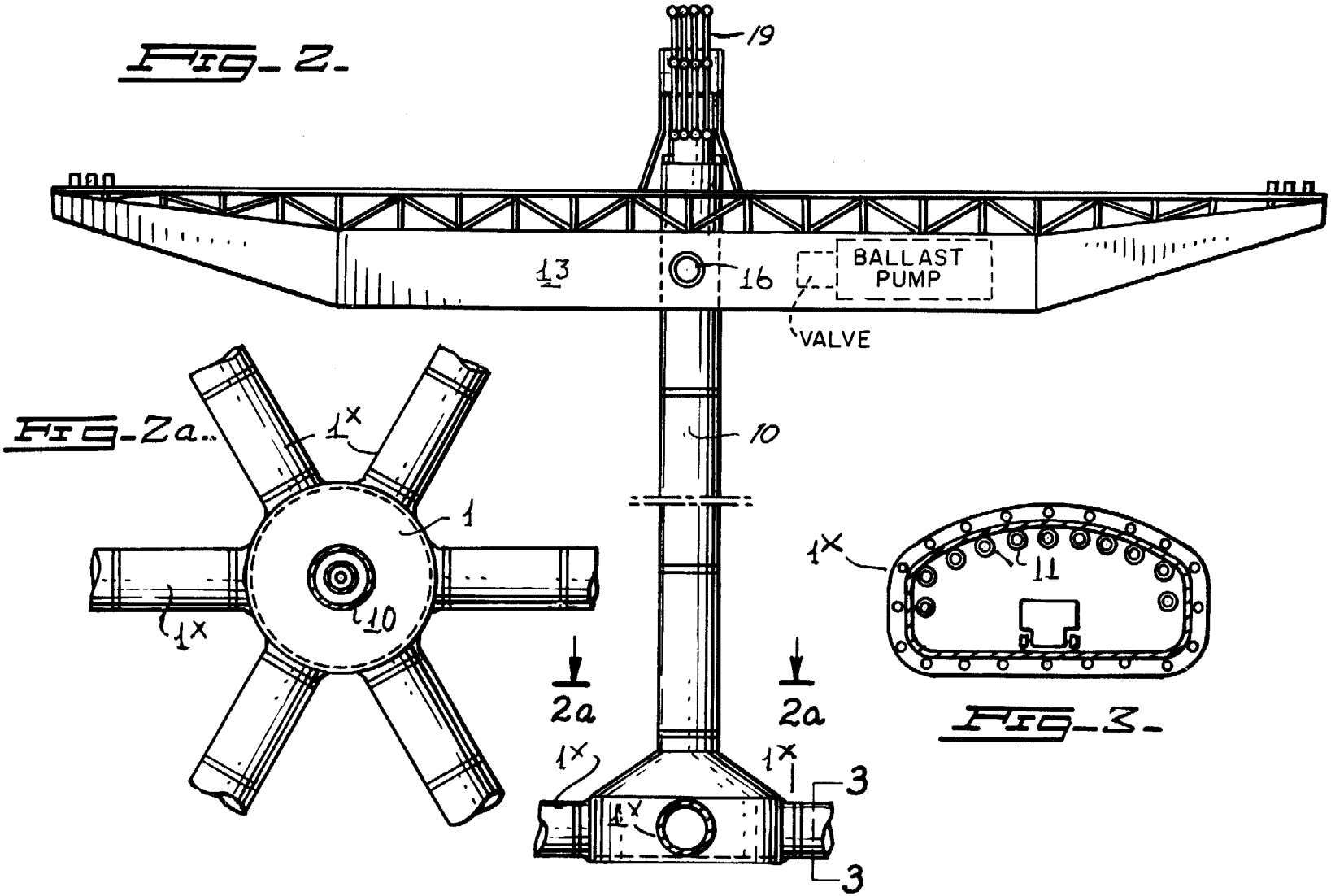
FIG. 2 is a side view of the stanchion, shown broken away, together with a side view of the "camel" in position
FIG. 2*a* is a top plan view, partly broken away, and schematically showing the stanchion connected to a plurality of oil discharge receiving tunneling radiating therefrom.
FIG. 3 is a vertical section, taken at line 3—3, FIG. 2, of a suitable tunnel with a rail track, carrier for personnel and materials, and oil conduit discharge piping.

It will be noted that in FIG. 2 an arrangement of radially directed conduits is shown leading from the base footing, so that oil received from the tankers may be directed to selected receiving points, as for example, to a plurality of refineries on shore points.

Referring to FIGS. 9 and 10, it will be seen that surrounding stanchion member 8, is a tubular stanchion member 9, and outwardly therefrom is a third tubular stanchion member 10, the latter directly enclosing the piles 3. The oil outflow piping, shown in FIG. 12 as four units for each tanker inflow conduits, lie adjacent the inner face of tubular stanchion member 9.

THE STANCHION CONSTRUCTION AT ITS TOP AREA AND THE TANKER OIL DISCHARGE CONDUITS AT SAID AREA

As shown in FIGS. 1 and 4, the tanker discharge conduits 19 are in swiveled sections so as to accommodate rise and fall of the berthed tanker or tankers, dotted lines in FIG. 4 indicating an extreme rise of two tankers, the lines being shown merely for indicating the action on the conduits. Reference to FIGS. 7 and 8 shows that the upper section of each four discharge conduits for a tanker is swiveled to a short conduit 20 which in turn is flow-swiveled to a horizontal manifold 22 (FIG. 8) which has swiveled flow connection at 22$^{x}$ with a vertical manifold 23. In FIG. 8 the arrangement is indicated as duplicated so as to provide flow connection simultaneously from two tankers.

The vertical manifold 23 is shown in FIGS. 7 and 8 as having outflow connection with the appurtenant oil discharge pipes 11, controlled by valves 11$^{x}$.

As shown in FIG. 8, a framework 23*a* supports a circular trackway 26, and brackets 27 on manifold 22 carry rollers on said trackway, by which fore and aft swing of the tanker or tankers, of course giving corresponding movement to the oil discharge conduits, will swing manifold 22 on its trackway. The arrangement is such that the tanker oil discharge conduits and horizontal manifold 22 can swing around the stanchion 360°.

When the "camel" is moored to a tanker or tankers, the mooring lines will move the "camel" around the stanchion in accord with the tanker movements relatively to such fore and aft movements of the latter. It is of important under certain conditions, particularly when the "camel" is not moored to a tanker, that it be free to move around the stanchion without connection with and pull upon the discharge oil conduits leading to the elements on the upper area of the stanchion which are rotationally supported. Reference will be made herein to the hinged plate connection between the camel and the stanchion, as shown schematically in FIG. 13 (at a submerged position of the camel).

THE "CAMEL" CONSTRUCTION AND ITS ACTION

The "camel" construction 13 is shown in position with two tankers moored to it in FIG. 1, and as to details in FIGS. 4, 5, 6 and 13. It comprises two connected pontoons, joined at their tapered ends, and the structure is sufficiently large for internal berthing for operators and for ballast and operating needs such as pumps, etc. The major connecting member of the "camel" to the stanchion is a collar 15, shown in FIGS. 5 and 6, which embraces the stanchion exterior tubular member to slide and rotate thereon. The collar 15 has an inner face being vertically curved so that it is of greater internal width at top and bottom areas than at the central area thereof and carries two opposed axles 16 on which the pontoons swivel in pitching of the "camel" by wave action. Also carried by the axles 16 is circular cushioning ring 17 inwardly faced with a wear-resisting cushioning material and which abuts the stanchion, but which will not prevent up and down movements of the collar on the stanchion.

As shown in FIGS. 1, 4 and 13, at 30, a rotatable sleeve is carried by the stanchion. In FIG. 7 it is shown that said sleeve carries arms 31 with rollers thereon entering the channelway of a circular track at 25, the rollers being indicated at 31$^{x}$. and at the top area of said sleeve 30 it is abutted by arms 27$^{x}$ extending from brackets 27, Thus the sleeve 30 is free to rotate independently of the tanker oil discharge conduits. Of course in any case where such freedom of rotation of the sleeve is not desired the arms 27$^{x}$ and 31 of FIG. 7 can be connected.

The rotatable sleeve 30 is connected to collar 15 of the "camel" structure by mutually hinged plates 28 and 29, as shown in FIGS. 13 and 14, in which figures the "camel" is in a lowermost position. The hinged plates serve to stabilize the "camel" in all positions, and so serve in the pitching, rise and fall, and fore and aft movements of the "camel."

SOME GENERAL FEATURES OF THE STRUCTURAL COMBINATION

The primary stanchion components are the two outer concentric stanchion tubular members, the outermost of said members constituting a strong protective envelope. Said outermost stanchion member is cushioned against the member it faces by rubber energy-absorbing elements, of which one form is shown in FIG. 9 at 35 as comprising heavy, resilient, winged elements, two of which will be employed at opposite sides of each pile 3, one element directly contacting the outermost stanchion tubular member and the second element directly abutting the stanchion member it faces, and the pile separating the wing members receiving a high degree of the stresses imposed by high winds and wave action caused thereby, particularlly in hurricanes, and typhoons.

The invention provides safe unloading of the largest sea-going tankers, requiring berthing depths of up to 100 fathoms. while at sea, and in the midst of severe storms, and by reason of the mooring of a tanker or tankers to the "camel" in berthing and, mooring the tanker cargo can be transferred in 20 foot swells, and while in hurricane and other high wind conditions, the tankers and "camel" move about the stanchion, even up to 350°. Further, as indicated hereinbefore, in typhoons and hurricanes and other violent atmosphere conditions, the "camel" may be ballasted so that it may submerge to a predetermined degree to wait out the turbulence.

It will be understood that various modifications may be made in the elements and their arrangement within the spirit of the invention and the claims, without departing from the spirit of the invention, one example being that the cushioning means between the stanchion outer tubular member, the piles and the stanchion tubular member at the inner faces of the files may be a known form of cushioning cylinder, piston and fluid within the cylinder, as indicated schematically in FIG. 6, at 35$^{x}$. The mutually facing cylinder joints 38 between the stanchion tubing primary members may be of flexible steel welded to the sections. The ballasting for the "camel" will be large ballast tanks, and hereinabove it has been stated that the "camel" will be equipped with pumping means therefor. Also as to the footing for the stanchion, while the drawings indicate fluid flow piping and nozzles for discharge outwardly of the footing floor, it will be understood that said piping with suitable pumps for fluid discharge into the footing can be used.

Having described my invention, what I claim and desire to protect by Letters Patent is as follows:

1. A combination of elements providing safety seep-sea berthing of large tankers and discharge therefrom to subaqueous conduit provision which is adapted to lead to a land terminal, comprising a stanchion having a footing for securing said stanchion to a deep-sea bed and with the stanchion rising to a height above the sea level, oil receiving means including piping internally carried by the stanchion at its top area and adaped for connection to tanker oil discharge conduits, in combination with two pontoons embracing the stanchion at opposite sides and forming a "camel," ballast means within the pontoons of the "camel" and pumping means therefor, so that the buoyancy of the pontoons can be adjusted to correspond with the buoyancy of the tanker, whereby response to the action of the sea swells by both will be in accord, and the stresses on the mooring lines from tanker to "camel" will be the same.

2. A combination of elements providing safety deep-sea berthing of large tankers and discharge of oil therefrom to a subaqueous conduit provision which is adapted to lead to a land terminal, comprising a stanchion having a footing for securing said stanchion to a deep-sea bed and with the stanchion rising to a height above the sea level, oil-receiving means including piping internally carried by the stanchion at its top area and adapted for connection to tanker oil discharge conduits, a floating "buffer" herein termed a "camel" with a side thereof adjacent the stanchion, mechanical connecting means for and between said side of the "camel" and the stanchion, said connecting means comprising a member slidingly and rotationally mounted on the stanchion, in combination with means for stabilizing action between the "camel" relatively to the stanchion, said means comprising a rotational sleeve around the stanchion at its upper area, and a plurality of arm-like struts which are mutually hinged and hinged to said sleeve and to the camel.

3. A combination of elements providing safety deep-sea berthing of large tankers and discharge of oil therefrom to a subaqueous conduit provision which is adapted to lead to a land terminal, comprising a stanchion having a footing for securing said stanchion to a deep-sea bed and with the stanchion rising to a height above the sea level, oil receiving means including piping internally carried by the stanchion and adapted for connection to tanker oil discharge conduits, a floating "buffer" vessel with a side thereof adjacent the stanchion, and mechanical connecting means for and between the side of said "buffer" vessel and the stanchion, said connecting means comprising a relatively wide collar slidingly and rotationally mounted on the stanchion, the inner face of the collar being vertically curved so that it is of greater internal width at top and bottom areas than at the central area thereof, a rigid axle carried by and projecting outwardly of the collar toward said "buffer" vessel, a receiving passage formed in the "buffer" vessel and receiving said axle, so that the "buffer" vessel is mounted on said axle and adapted to "pitch" fore and aft as by sea wave action, and to rock laterally with relation to the stanchion, and also to rotate around the stanchion, whilst held by said connecting means and to directly effect vertical movements of the collar on the stanchion through contact with said axle.

4. A combination of elements providing safety seep-sea berthing of large tankers and discharge of oil therefrom to a subaqueous conduit provision which is adapted to lead to a land terminal, and comprising a stanchion having a footing for securing said stanchion to a deep-sea bed and with the stanchion rising to a height above the sea level, oil receiving piping carried by the stanchion at its top area and adapted for connection to tanker oil discharge conduits, in which the stanchion is constructed of tubular elements including two primary concentric tubes formed in sections, wherein the sections of the outer primary tube are joined by jointoforming elements comprising two opposed mutually facing annular joint forming elements having flexing ability to afford moderate movement of said outer primary tube stanchion sections, in response to the forces of wind, tides, sea swells, and tanker movements.

5. A combination of elements providing safety deep-sea berthing of large tankers and discharge of oil therefrom to a subaqueous conduit provision which is adapted to lead to a land terminal, in accordance with claim 4, in which the stanchion footing is formed as a water-tight chamber having a floor, a plurality of nozzles in the floor and directed for discharge outwardly, pumping and suction means, piping connecting said last named means with said nozzles for simultaneous action thereof to assist sinking of the stanchion into the sea-bed, adapted to produce a vacuum and also to permit material such as fluid to be passed into the footing for ballasting therein.

6. A combination of elements providing safety deep-sea berthing of large tankers and discharge of oil therefrom to a sub-aqueous conduit provision which is adapted to lead to a land terminal, comprising a stanchion having a footing for securing the stanchion to a deep-sea bed with the stanchion rising to a height above the sea level, oil receiving means including piping imternally carried by the stanchion at its top area and adapted for connection to tanker oil discharge conduits and to receiving means within the stanchion, for said oil, an outer and an inner stanchion wall, in which the outer wall of the stanchion in use directly receives the forces of the sea and winds, in combination with piles within the stanchion and facing the outer wall thereof, said piles extending from the top area of the stanchion to the base of the footing therefor, and means for bracing said stanchion outer wall, including said piles and laterally spaced strong and compressible members abutting the inner and outer walls of the stanchion and abutting the piles.

* * * * *